US006539701B2

(12) United States Patent
Fuentes et al.

(10) Patent No.: US 6,539,701 B2
(45) Date of Patent: Apr. 1, 2003

(54) AIR DISTILLATION AND ELECTRICITY GENERATION PLANT AND CORRESPONDING PROCESS

(75) Inventors: Francois Fuentes, Le Vesinet (FR); Richard Dubettier, La Varenne (FR); Carina Zundel, Paris (FR)

(73) Assignee: L'Air Liquide - Societe Anonyme a Directoire et Conseil de Surveillance pour L'Etude et L'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/902,609

(22) Filed: Jul. 12, 2001

(65) Prior Publication Data

US 2002/0020165 A1 Feb. 21, 2002

(30) Foreign Application Priority Data

Jul. 12, 2000 (FR) ..... 00 09100

(51) Int. Cl.[7] ..... F02G 1/00
(52) U.S. Cl. ..... 60/39.19; 60/39.181; 202/158
(58) Field of Search ..... 60/39.19, 39.181; 202/158, DIG. 20

(56) References Cited

U.S. PATENT DOCUMENTS 4,178,763 A * 12/1979 Stern et al. ..... 60/667
4,372,764 A * 2/1983 Theobald ..... 62/13
5,060,480 A * 10/1991 Saulnier ..... 62/9
5,410,869 A 5/1995 Muller
5,666,825 A 9/1997 Darredeau et al.
6,281,601 B1 * 8/2001 Edelman et al. ..... 307/29
6,393,821 B1 * 5/2002 Prabhu ..... 60/39.02

FOREIGN PATENT DOCUMENTS

DE 3908505 A1 9/1989
EP 0 357 299 3/1990
EP 0 519 688 A1 12/1992
GB 0465193 A1 * 1/1992

* cited by examiner

*Primary Examiner*—Charles G. Freay
*Assistant Examiner*—John Belena
(74) *Attorney, Agent, or Firm*—Young & Thompson

(57) ABSTRACT

A plant (1) includes, an air distillation apparatus (4) having at least one outlet (25) for a nitrogen-rich fluid and an outlet (32) for a product to be delivered in the liquid state and a gas turbine unit (3) having a combustion chamber (17) and an electricity-generating turbine (18), the intake of which is connected to an outlet of the combustion chamber. An expander (13) for expanding a nitrogen-rich fluid in order to generate refrigerating power allowing the liquid product to be delivered, the air distillation apparatus being connected in parallel to the expander (13) and to the intake of an electricity-delivering turbine in order to feed them with at least one nitrogen-rich fluid. Control elements (41,42) are provided for controlling the flow rates of the nitrogen-rich fluid streams sent to the expander (13) and to the electricity-generating turbine (18), respectively, and determination elements (40) for determining the electrical power to be generated by the electricity-generating turbine (18).

12 Claims, 2 Drawing Sheets

AIR DISTILLATION AND ELECTRICITY GENERATION PLANT AND CORRESPONDING PROCESS

BACKGROUND OF THE INVENTION

The present invention relates to a plant for distilling air and for generating electricity, of the type comprising, on the one hand, an air distillation apparatus having at least one outlet for a nitrogen-rich fluid and an outlet for a product to be delivered in the liquid state and, on the other hand, a gas turbine unit comprising a combustion chamber and an electricity-generating turbine, the intake of which is connected to an outlet of the combustion chamber, the plant furthermore comprising means for expanding a nitrogen-rich fluid in order to generate refrigerating power allowing the said liquid product to be delivered, the air distillation apparatus being connected in parallel to these expansion means and to the intake of the electricity-delivering turbine in order to feed them with at least one nitrogen-rich fluid.

It is frequent on industrial sites for a gas turbine unit to be alongside an air distillation apparatus. The gas turbine unit and the air distillation apparatus generally operate independently.

The gas turbine unit contributes, for example, to the supply of an electrical distribution network.

The air distillation apparatus delivers products coming from the air distillation, typically a nitrogen-rich fluid and an oxygen-rich fluid. At least one of these products is usually delivered in the liquid state, making it easier to store it.

The maximum instantaneous electrical power that a gas turbine unit can deliver is generally limited by the characteristics of the compressor that such a unit usually has upstream of its combustion chamber.

A plant of the aforementioned type is also known from EP-A-0 465 193. In this plant, the stream of nitrogen-rich fluid sent to the electricity-generating turbine is used to increase the maximum power delivered by the gas turbine unit above the limit imposed by the characteristics of the compressor of this unit. Thus, it is possible, by virtue of this characteristic, to modify a plant for distilling air and for generating electricity in order to meet a permanent increase in the requirements of consumers of the electrical distribution network.

However, the plant described in that document does not allow it to be adapted to the seasonal variations in the requirements of the consumers of such a network.

SUMMARY OF THE INVENTION

It is one of the objects of the invention to solve this problem by providing a plant of the aforementioned type allowing it to be easily adapted to the temporary variations in the electricity requirements of the consumers of a distribution network supplied by this plant.

For this purpose, the subject of the invention is a plant of the aforementioned type, characterized in that it comprises control means for controlling the flow rates of the nitrogen-rich fluid streams sent to the expansion means and to the electricity-generating turbine, respectively, and determination means for determining the electrical power to be generated by the electricity-generating turbine.

Depending on the particular embodiments, the plant may comprise one or more of the following characteristics, taken separately or in any technically possible combinations:

the expansion means comprise a turbine;

the plant includes a heat exchanger for cooling the liquid product to be delivered, connected to the outlet of the expansion means;

the plant includes a heat exchanger for cooling the air to be distilled, connected to an outlet of the expansion means;

the plant includes means for compressing a nitrogen-rich fluid, these being placed between the air distillation apparatus and the intake of the electricity-generating turbine;

the plant includes means for warming a nitrogen-rich fluid, these being placed between the air distillation apparatus and the intake of the electricity-generating turbine;

the air distillation apparatus is connected in parallel to the expansion means and to the electricity-generating turbine via the same nitrogen-rich fluid outlet;

the plant includes a control unit for controlling the flow rate means, which unit is designed to increase the flow rate of the nitrogen-rich fluid stream feeding the electricity-generating turbine when the electrical power to be generated increases; and the control unit is designed to decrease the flow rate of the nitrogen-rich fluid stream feeding the electricity-generating turbine when the electrical power to be generated decreases.

The subject of the invention is also a process for generating electricity and for distilling air by means of a plant as defined above, characterized in that the flow rate of the nitrogen-rich fluid stream feeding the electricity-generating turbine is increased when the electrical power to be generated increase.

According to a variant, the flow rate of the nitrogen-rich fluid stream feeding the electricity-generating turbine is decreased when the electrical power to be generated decreases.

BRIEF DESCRIPTION OF THE DRAWINGS

The invention will be more clearly understood on reading the description which follows, given solely by way of example and with reference to the appended figures in which.

DESCRIPTION OF THE PREFERRED EMBODIMENTS

Figure 1:
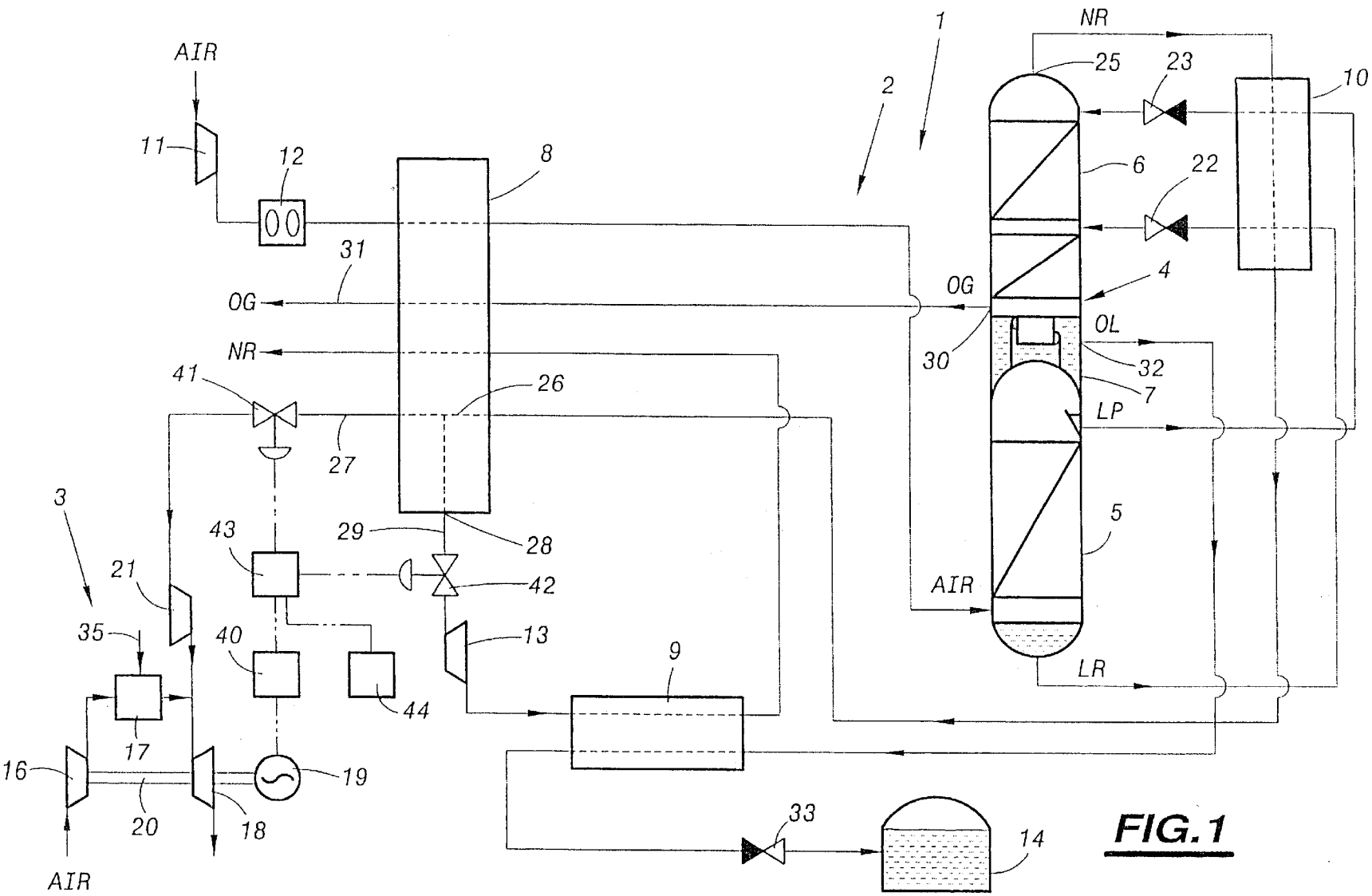
FIG. 1 is a schematic view of a plant according to the invention.

FIG. 1 shows a plant 1 for distilling air and for delivering electricity, which comprises an air distillation unit 2 and a gas turbine unit 3.

The air distillation unit 2 essentially comprises:

an air distillation apparatus in the form of a double column 4 comprising a medium-pressure column 5, a low-pressure column 6 and a reboiler-condenser 7;

a main heat-exchange line 8;

two auxiliary heat exchangers 9 and 10;

an air compressor 11;

an adsorption-type purification apparatus 12;

a turbine 13; and a liquid-oxygen storage tank 14.

The gas turbine unit 3 essentially comprises:

an air compressor 16;

a combustion chamber 17;

a turbine 18;

an alternator 19 driven by a shaft 20 common to the compressor 16 and to the turbine 18; and a compressor 21.

The overall operation of the air distillation unit 2 is as follows.

The air to be distilled, precompressed by the compressor 11 and purified by the apparatus 12, is cooled by the main heat-exchange line 8 down to near its dew point and then introduced into the bottom of the medium-pressure column 5.

The reboiler-condenser 7 boils off liquid oxygen, generally having a purity greater than 90% and typically 99.5%, at the bottom of the low-pressure column 6 by condensation of the nitrogen 7 at the top of the medium-pressure column 5.

"Rich liquid" LR (air enriched with oxygen), withdrawn from the bottom of the medium-pressure column 5, is subcooled on passing through the auxiliary heat exchanger 10, then expanded in an expansion valve 22 and finally injected at an intermediate level into the low-pressure column 6.

"Lean liquid" LP (more or less pure nitrogen), withdrawn from the top of the medium-pressure column 5, is subcooled on passing through the auxiliary heat exchanger 10, then expanded in an expansion valve 23 and finally injected into the top of the low-pressure column 6.

Impure or "waste" nitrogen NR, withdrawn from the top of the low-pressure column 6 via an outlet 25, is warmed on passing through the auxiliary heat exchanger 10 and then sent through a series of passages 26 in the main heat-exchange line 8.

The waste nitrogen passes through these passages 26, cooling the air to be distilled. This waste nitrogen is divided, within the passages 26, into two streams, the first of which passes through the passages 26 over their entire length and is then sent to the gas turbine unit 3 via a line 27, as described below.

The second stream passes through only an upstream portion of the passages 26 and is then sent via an intermediate outlet 28 and a line 29 to the turbine 13. This second waste nitrogen stream is expanded therein, and therefore cooled, and then passes through the auxiliary heat exchanger 9 where it is warmed before being sent to the main heat-exchange line 8 so as again to help to cool the air to be distilled in a series of passages separate from the passages 26.

Gaseous oxygen, withdrawn from the bottom of the low-pressure column 6 via an outlet 30, is warmed on passing through the main heat-exchange line 8 and delivered via a production line 31.

Liquid oxygen is withdrawn from the bottom of the low-pressure column 6 via an outlet 32 and then sent to the auxiliary heat exchanger 9 where it is subcooled by the second waste nitrogen stream. Next, this liquid oxygen is expanded in an expansion valve 33, to a pressure slightly above atmospheric pressure, before feeding the tank 14.

The overall operation of the gas turbine unit 3 is as follows. Air is compressed by the compressor 16 and then sent to the combustion chamber 17 into which a pressurised fuel such as natural gas is introduced via a line 35.

The gases produced by the combustion in the chamber 17 are sent to the intake of the turbine 18 where they expand, driving the compressor 16 and the alternator 19. The alternator 19 supplies, for example, an electrical distribution network.

The first waste nitrogen stream flowing in the line 27 is compressed in the compressor 21, where it reaches approximately the pressure of the gases produced by the chamber 17, and is then sent to the intake of the turbine 18, where it expands with the gases produced by the combustion chamber 17.

The waste nitrogen outlet 25 of the low-pressure column 6 is therefore connected in parallel to the turbine 18, downstream of the combustion chamber 17, and to the turbine 13.

Thus, the waste nitrogen can be used to increase the electrical power delivered by the gas turbine unit 3, by increasing the flow rate of the flow through the turbine 18, but also to deliver liquid oxygen by virtue of its expansion in the turbine 13 which produces the necessary refrigerating power.

In order to assign the waste nitrogen to electricity generation or to the liquid oxygen production, the plant 1 furthermore includes:

determination means 40 for determining the instantaneous electrical power delivered by the alternator 19;

a control valve 41 for controlling the flow rate of the first waste nitrogen stream, placed in the line 27;

a control valve 42 for controlling the flow rate of the second waste nitrogen stream, placed in the line 29;

an electronic control unit 43 electrically connected to the determination means 40 and to the control valves 41 and 42; and determination means 44 for determining the instantaneous electrical power to be delivered.

The electronic control unit 43 typically comprises a microprocessor suitably programmed to control the flow rates of waste nitrogen flowing in the lines 27 and 29, as described below.

The unit 43 compares the values delivered by the determination means 40 and 44. When the electrical power to be delivered is greater than that delivered by the alternator 19, that is to say when the electrical requirements of the network supplied by the alternator 19 increase, the control unit 43 then operates the valves 41 and 42 in order to increase the flow rate of the first waste nitrogen stream and decrease the flow rate of the second waste nitrogen stream.

Thus, the flow rate of the gases expanded in the turbine 18 increases and the alternator 19 can deliver the additional electrical power demanded. The maximum electrical power that can be delivered is therefore not limited by the characteristics of the compressor 16, but by those of the turbine 18.

Since the flow rate of the second waste nitrogen stream has been decreased, the air distillation unit 2 delivers a lesser amount of liquid oxygen. This is not a problem, even if the liquid oxygen demand by consumers increases, since it is possible to use all of the liquid oxygen stored in the tank 14 to meet their demand.

In a variant (not shown) of the plant of FIG. 1, the control valve 42 may, if necessary, be completely closed, all of the waste nitrogen then being sent to the gas turbine unit 3. In this case, the refrigeration of the distillation column 4 is, for example, maintained by sending liquid oxygen from the tank 14 back into the main heat-exchange line 8 or by any other means, such as a turbine for blowing the air to be distilled into the low-pressure column.

Conversely, when the electrical power to be delivered is less than the electrical power delivered, that is to say when the requirements of the network supplied by the alternator decrease, the control unit 43 causes the flow rate of the second stream to increase and the flow rate of the first stream to decrease.

If necessary, the control valve 41 may be completely closed, all of the waste nitrogen then being sent to the turbine 13 in order to feed the tank 14 with liquid oxygen.

It is then possible to increase the amount of liquid oxygen stored in the tank 14 for a new period in which the electrical power to be delivered will be high.

Thus, the plant of FIG. 1 allows simple tailoring of the electrical power delivered by the gas turbine unit 3 to the electricity requirements without being limited by the characteristics of the compressor 16.

More generally, the structure of the gas turbine unit 3 may be different, the combustion chamber 17 possibly being fed with a pressurised oxidiser, such a air, by various means.

The first waste nitrogen stream may also be warmed before being sent to the turbine 18.

Likewise, the above principles are not limited to a unit 2 comprising a double distillation column. Thus, any type of air distillation apparatus, having an air inlet and outlets for nitrogen-rich and oxygen-rich fluids, may be used. The or an outlet for the nitrogen-rich fluid is then connected in parallel to the turbines 13 and 18.

The valves 41 and 42 can be incorporated in the compressor 21 and the turbine 23, respectively, for example in the form of nozzle guide vanes.

It should also be noted that the second waste nitrogen stream may be expanded by various means so as to allow production of a product, such as oxygen, nitrogen or even argon, in the liquid state. It is not necessary for this second expanded stream and the product to be delivered in the liquid state to pass through the same heat exchanger.

Figure 2:
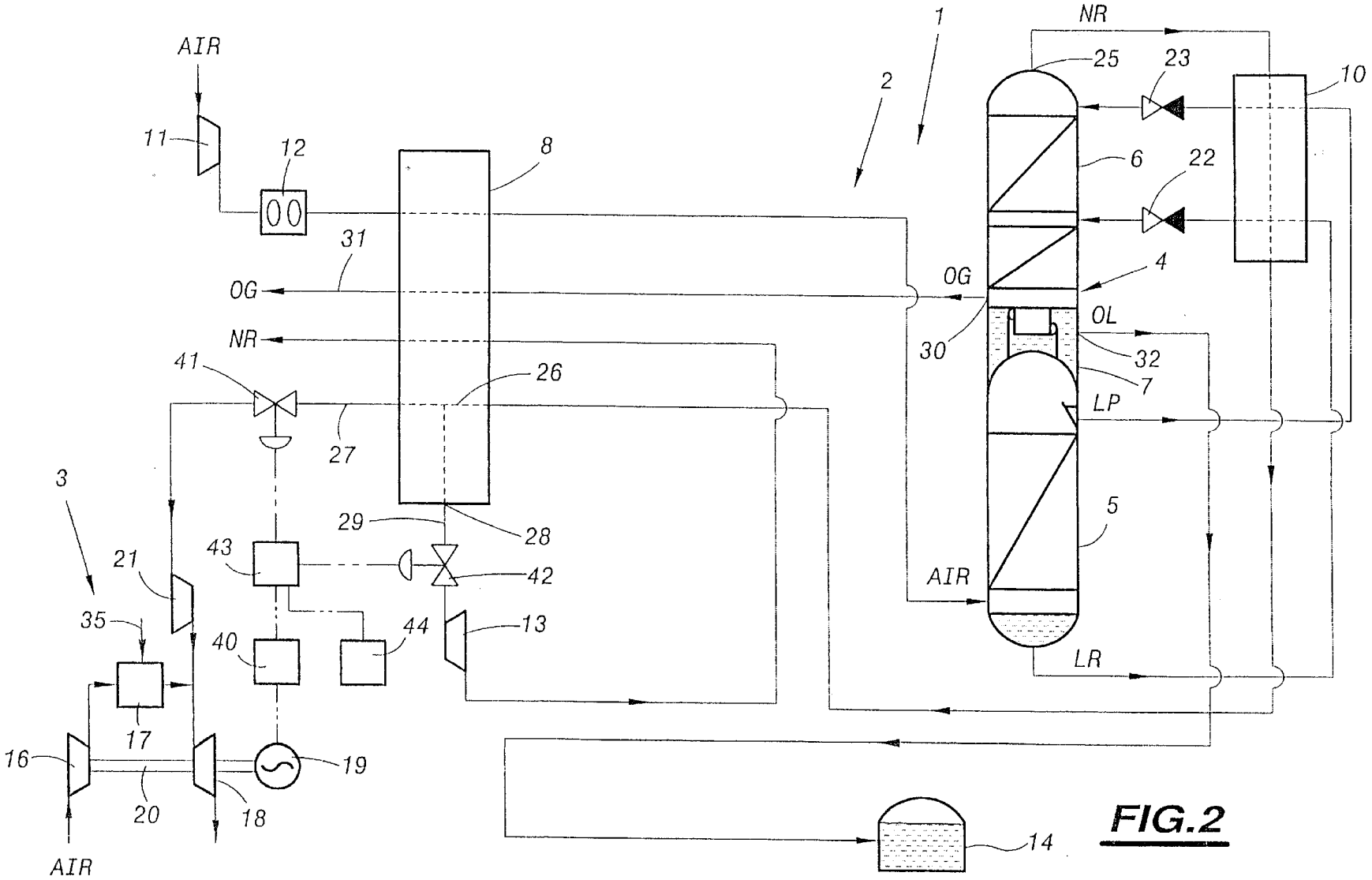
FIG. 2 is a schematic view of a variant of the plant of FIG. 1.

Thus, in the variant shown in FIG. 2, the second waste nitrogen stream, after its expansion in the turbine 13, is sent directly to the heat-exchange line 8, the auxiliary heat exchanger 9 and the expansion valve 33 having been omitted.

The liquid oxygen is then stored, to within the head losses, at the operation pressure of the low-pressure column, which may be well above atmospheric pressure.

It is not then necessary to subcool the liquid oxygen withdrawn via the outlet 25.

In a variant (not shown), the turbine 18 may be a turbine of which one upstream stage is mechanically connected by a first shaft to the compressor 16 in order to drive it and of which a downstream stage is mechanically connected by a separate second shaft to the alternator 19 in order to drive it.

According to yet another variant (not shown), the waste nitrogen coming from the outlet 25 may be divided into two streams upstream of the auxiliary heat exchanger 10 and therefore upstream of the main heat-exchange line 8.

The first stream is then compressed, then warmed on passing through the main heat-exchange line 8 and finally fed into the turbine 18. The second stream passes through the auxiliary heat exchanger 10 and then the upstream portion of the passages 26 of the main heat-exchange line 8. Thereafter, the second stream follows the path in the embodiment shown in FIG. 1.

According to other variants (not shown), the turbines 13 and 18 may be connected to two separate nitrogen-rich fluid outlets. Thus, the turbine 13 may be connected to the outlet 25 as shown in FIG. 1, whereas a portion of the lean liquid LP is sent to a pump and then into the main heat-exchange line 8 before being fed into the turbine 18.

What is claimed is:

1. A plant (1) for distilling air and for generating electricity, comprising, an air distillation apparatus (4) having at least one outlet (25) for a nitrogen-rich fluid and an outlet (32) for a product to be delivered in the liquid state, a gas turbine unit (3) comprising a combustion chamber (17) and an electricity-generating turbine (18), an intake of which is connected to an outlet of the combustion chamber, means (13) for expanding the nitrogen-rich fluid in order to generate refrigerating power cooling the liquid product to be delivered, the air distillation apparatus being connected to the means (13) for expanding and to the intake of the electricity-delivering turbine (18) in order to feed them with the nitrogen-rich fluid, control means (41,42) for controlling flow rates of the nitrogen-rich fluid streams sent to the means (13) for expanding and to the electricity-generating turbine (18), respectively, and determination means (40) for determining the electrical power to be generated by the electricity-generating turbine (18).

2. The plant according to claim 1, wherein the expansion means comprise a turbine (13).

3. The plant according to claim 1, further comprising a heat exchanger (9) for cooling the liquid product to be delivered, connected to an outlet of the expansion means (13).

4. The plant according to claim 1, further comprising a heat exchanger (8) for cooling the air to be distilled, connected to an outlet of the expansion means (13).

5. The plant according to claim 1, further comprising means (21) for compressing a nitrogen-rich fluid, these being placed between the air distillation apparatus (4) and the intake of the electricity-generating turbine (18).

6. The plant according to claim 1, further comprising means for warming a nitrogen-rich fluid, these being placed between the air distillation apparatus (4) and the intake of the electricity-generating turbine (18).

7. The plant according to claim 1, wherein the air distillation apparatus is connected to the expansion means (13) and to the electricity-generating turbine (18) via the same nitrogen-rich fluid outlet (26).

8. The plant according to claim 7, further comprising a control unit (43) for controlling the flow-rate control means (41,42), which unit is designed to increase the flow rate of the nitrogen-rich fluid stream feeding the electricity-generating turbine (18) when the electrical power to be generated increases.

9. The plant according to claim 8, wherein the control unit is designed to decrease the flow rate of the nitrogen-rich fluid stream feeding the electricity-generating turbine (18) when the electrical power to be generated decreases.

10. A process for generating electricity and distilling air by means of the plant according to claim 1, wherein the flow rate of the nitrogen-rich fluid stream feeding the electricity-generating turbine (18) is increased when the electrical power to be generated increases.

11. The process according to claim 10, wherein the flow rate of the nitrogen-rich fluid stream feeding the electricity-generating turbine (18) is decreased when the electrical power to be generated decreases.

12. A plant for distilling air and for generating electricity, comprising:

an air distillation apparatus having a first outlet for a first nitrogen-rich product and a second outlet for a second product that is to be delivered as a liquid;

a gas turbine unit with a combustion chamber and a first electricity-generating turbine with an intake connected to an outlet of the combustion chamber;

a second turbine for expanding the first nitrogen-rich product to generate refrigerating power for cooling the second product;

a first valve connecting the first outlet for the first nitrogen-rich product to the second turbine;

a second valve connecting the first outlet for the first nitrogen-rich product to the intake of the first electricity-delivering turbine;

a first device that determines an amount of electrical power generated by the electricity-generating turbine;

a second device that determines a demand for electrical power; and a control unit responsive to the first and second devices that controls the first and second valves so that the amount of electrical power generated by the electricity-generating turbine corresponds to the demand.

* * * * *